US008561916B1

(12) United States Patent
Remington et al.

(10) Patent No.: US 8,561,916 B1
(45) Date of Patent: Oct. 22, 2013

(54) MOVABLE BRIDGE JOINT, ASSOCIATED SUPPORT AND RAIL BRIDGE PANEL CONTAINING SAME

(75) Inventors: James A. Remington, Shelffield Village, OH (US); Karl E. Axthelm, Chagrin Falls, OH (US)

(73) Assignee: Cleveland Track Material, Inc., Cleveland, OH (US)

( * ) Notice: Subject to any disclaimer, the term of this patent is extended or adjusted under 35 U.S.C. 154(b) by 0 days.

(21) Appl. No.: 13/433,572

(22) Filed: Mar. 29, 2012

(51) Int. Cl.
*E01B 11/00* (2006.01)

(52) U.S. Cl.
USPC ..... 238/151; 238/17; 238/171; 238/174

(58) Field of Classification Search
USPC ..... 238/17, 18, 19, 151, 152, 153, 154, 238/155, 156, 159, 160, 161, 165, 171, 174, 238/175
See application file for complete search history.

(56) References Cited

U.S. PATENT DOCUMENTS

| | | | | | |
|---|---|---|---|---|---|
| 476,165 | A | | 5/1892 | O'Shea | |
| 998,542 | A | | 4/1911 | Bohannan | |
| 2,067,695 | A | * | 1/1937 | Conley | 238/171 |
| 3,008,644 | A | * | 11/1961 | Wagner | 238/171 |
| 4,171,774 | A | * | 10/1979 | Deslauriers | 238/171 |
| 4,785,994 | A | * | 11/1988 | Crone et al. | 238/171 |
| 4,824,015 | A | * | 4/1989 | Farrell et al. | 238/336 |
| 5,176,318 | A | * | 1/1993 | Young et al. | 238/17 |
| 5,238,186 | A | * | 8/1993 | Young et al. | 238/17 |
| 5,560,571 | A | * | 10/1996 | Remington | 246/468 |
| 5,590,833 | A | * | 1/1997 | Benenowski et al. | 238/171 |
| 5,651,499 | A | * | 7/1997 | Mihailoff et al. | 238/22 |
| 5,746,400 | A | * | 5/1998 | Remington et al. | 246/465 |
| 6,000,624 | A | * | 12/1999 | Marron | 238/174 |
| 6,068,196 | A | * | 5/2000 | Benenowski et al. | 238/171 |
| 6,308,897 | B1 | * | 10/2001 | Remington et al. | 238/292 |
| 6,363,564 | B1 | * | 4/2002 | Weaver | 14/56 |
| 6,393,644 | B1 | * | 5/2002 | Weaver | 14/73.1 |
| 6,672,516 | B1 | * | 1/2004 | Skoutelas | 238/174 |
| 6,997,419 | B1 | * | 2/2006 | Remington et al. | 246/453 |
| 8,113,441 | B2 | * | 2/2012 | Urmson et al. | 238/153 |
| 8,313,041 | B2 | * | 11/2012 | Remington et al. | 238/333 |
| 8,403,235 | B2 | * | 3/2013 | Ortiz Rivas | 238/151 |
| 8,418,932 | B2 | * | 4/2013 | Seki et al. | 238/17 |
| 8,424,812 | B1 | * | 4/2013 | Voelkerding et al. | 246/468 |
| 8,424,813 | B1 | * | 4/2013 | Voelkerding et al. | 246/468 |
| 2002/0020032 | A1 | * | 2/2002 | Weaver | 14/65 |
| 2005/0098646 | A1 | * | 5/2005 | Urmson et al. | 238/151 |
| 2008/0000999 | A1 | * | 1/2008 | Remington et al. | 238/167 |
| 2011/0121088 | A1 | * | 5/2011 | Seki et al. | 238/17 |
| 2011/0204153 | A1 | * | 8/2011 | Weaver et al. | 238/17 |
| 2012/0111958 | A1 | * | 5/2012 | Urmson et al. | 238/159 |

* cited by examiner

*Primary Examiner* — Jason C Smith
(74) *Attorney, Agent, or Firm* — Roger A. Gilcrest

(57) ABSTRACT

The invention may be described as a rail bridge joint, associated guard plate assembly, and a bridge assembly incorporating same.

15 Claims, 16 Drawing Sheets

MOVABLE BRIDGE JOINT, ASSOCIATED SUPPORT AND RAIL BRIDGE PANEL CONTAINING SAME

RELATED APPLICATION DATA

None.

FIELD OF THE INVENTION

The present invention relates to railroad track bridges and related joint assemblies.

BACKGROUND OF THE INVENTION

The present invention relates to joint assemblies and arrangements for a railway bridge. A railway bridge is employed where a section of track must be repeatedly and reversibly raised and lowered with respect to another, stationary track section, so as to move a section of track, typically to allow for the passage of a ship through a waterway over which the bridge extends.

Typically, railroad bridge components require secure positioning of the constituent track sections when in the closed position so as to maintain a continuous and uniform wheel path as the railroad track endures repetitive impact and stress, as well as extreme inertial forces attendant to lateral movement of the wheels, especially in cases where the run up to the bridge is not straight.

The adjoining rail of a railway bridge assembly includes a tapered rail portion of the bridge approach section which typically terminates into a tapered end point for mating with a correspondingly shaped rail portion of the movable or lift portion of the rail bridge.

Because such rail bridge joints comprise portions that must be repeatedly moved with respect to one another to be engaged and disengaged, the rail portions must be repeatedly and securely moved from an engaged position, re-registered in an engaged position, and held in place in a guarded condition, such that the wheel remains on the tread-bearing surfaces as it proceeds through the bridge joint region.

In addition, rail bridge joints experience considerable wear due to the repeated contact between the moving wheels and the wheel engaging surfaces of the guard rail. These rail guards are designed to capture the wheel flange and direct it through the bridge joint region.

In prior art arrangements, rail bridge joints used a multiple piece arrangement to support a stock rail held between guard plates. Examples of such arrangements are shown in U.S. Pat. No. 6,672,516, which is hereby incorporated herein by reference and over which the present invention represents an improvement.

Such rail guard arrangements also carry the risk of derailment because their constituent assembly pieces would be subject to dislodgement over time, causing insecurity in the wheel's path.

Accordingly, it is desirable to provide a rail bridge arrangement that allows for secure and reliable repetitive disengagement and re-engagement of the constituent bridge portions, while providing a uniform, secure wheel path that distributes load and reduces wheel and guard wear, all while extending the service life of the constituent parts.

The embodiments of the invention described herein address the shortcomings of the prior art.

SUMMARY OF THE INVENTION

The present invention may be used for any type of movable rail bridge or other arrangement requiring movement of rail track between engaged and disengaged positions.

Guarded Rail Section for Movable Rail Bridge Joint Featuring the Solid Billet Casting In general terms, the invention may be described as a guarded rail section for a movable bridge rail joint, the arrangement comprising: (a) a gage side guard plate having a gage side guard plate interior surface, (b) a field side guard plate having a field side guard plate interior surface, the gage side guard plate and field side guard plate defining a rail channel; and (c) a rail portion disposed in the rail channel and comprising a single machined billet having a gage side and a field side, a lead end, a terminal end, a tread-bearing surface and a lower portion having flat lateral sides, and preferably being substantially rectangular in cross-section along its bottom, the lower portion extending substantially the entire distance between the gage side guard plate interior surface and the field side guard plate interior surface, and the rail portion comprising a flangeway machined alongside the tread-bearing surface. The lower portion of the rail portion is in supportive contact with the gage side guard plate interior surface and the field side guard plate interior surface.

The term billet used to describe the present invention may also be construed as any bloom, casting or forging.

It is preferred that the assembly additionally comprises a base plate supporting the field side guard plate, the gage side guard plate, and the rail portion. The flangeway comprises a flangeway floor and the gage side guard plate extends alongside the flangeway floor.

It is preferred that the terminal end of the rail portion has a tapered miter joint cut. The terminal end of the rail portion resides between the guard plate interior surface and the field plate interior surface, where this construction is used as the approach side of the rail joint. Conversely, the guard plate interior surface and the field plate interior surface define a space and wherein the terminal end of the rail portion extends outside the space, where this construction is used as the lift side of the rail joint.

It is also preferred that the gage side guard plate top surface and the field side guard plate top surface extend above the flangeway floor.

In a most preferred embodiment, the gage side guard plate interior surface defines an insert channel along its top portion, there is provided a top portion insert removably attached into the insert channel, and the top portion insert comprises a top portion interior surface, and the top portion interior surface is substantially co-extensive with the gage side guard plate interior surface.

In another preferred aspect of the invention, the tread-bearing surface is substantially flat and is sloped upward from said gage side of said rail portion toward the field side of the rail portion and at an angle in the range of from about 1 in 10 to about 1 in 40 that would be conformal in nature so as to accommodate the slope of the railroad wheel tread typically sloped at about 1 in 20. Most preferably, the field side upper portion of said sloped tread-bearing surface is sufficiently notched so as to provide clearance for the outer lip false flange formed in worn rail car wheels.

The assembly of the present invention is preferably adapted to have a stock rail welded onto the rail portion on the lead end. Preferably, the lead end of the rail portion is provided with a reduction portion so as to have a cross-sectional profile matching that of a stock rail, such that the stock rail may be welded onto the lead end, such as by friction butt welding or equivalent joining or fixture attachment methods.

Movable Rail Bridge Joint Featuring Solid Billet Casting

Another aspect of the present invention is a movable rail bridge joint arrangement comprising: (a) a stationary portion having: (i) a first gage side guard plate having a first gage side guard plate interior surface, (ii) a first field side guard plate having a first field side guard plate interior surface, the first gage side guard plate and first field side guard plate defining a rail channel; and (iii) a first rail portion disposed in the rail channel and comprising a single machined billet having a gage side and a field side, a terminal end, a tread-bearing surface and a lower portion, the lower portion extending substantially the entire distance between the gage side guard plate interior surface and the field side guard plate interior surface, and the first rail portion comprising a flangeway machined alongside the tread-bearing surface; the terminal end of the first rail portion disposed between the first gage side guard plate and the first field side guard plate; and (b) a movable portion having (i) a second gage side guard plate having a second gage side guard plate interior surface, (ii) a second field side guard plate having a second field side guard plate interior surface, the second gage side guard plate and second field side guard plate defining a rail channel; and (iii) a second rail portion disposed in the rail channel and comprising a single machined billet having a gage side and a field side, a terminal end, a tread-bearing surface and a lower portion, the lower portion extending substantially the entire distance between the gage side guard plate interior surface and the field side guard plate interior surface, and the second rail portion comprising a flangeway machined alongside the tread-bearing surface; the second guard plate interior surface and the second field plate interior surface defining a space and wherein the terminal end of the second rail portion extends outside the space; and wherein the movable portion is adapted to be moved between (1) a raised position and (2) a lowered position adjacent the stationary rail portion, such that the respective tread-bearing surfaces of the first and second portions are in substantial alignment.

The rail guard assembly may be any of the embodiments described herein.

The movable rail bridge joint arrangement of the present invention also comprising: (a) a stationary portion having a first pair of parallel guarded rail sections, each comprising: (i) a first gage side guard plate having a first gage side guard plate interior surface, (ii) a first field side guard plate having a first field side guard plate interior surface, the first gage side guard plate and first field side guard plate defining a rail channel; and (iii) a first rail portion disposed in the rail channel and comprising a single machined billet having a gage side and a field side, a terminal end, a tread-bearing surface and a lower portion, the lower portion extending substantially the entire distance between the gage side guard plate interior surface and the field side guard plate interior surface, and the first rail portion comprising a flangeway machined alongside the tread-bearing surface; the terminal end of the first rail portion disposed between the first gage side guard plate and the first field side guard plate; and (b) a movable portion having a second pair of parallel guarded rail sections, each comprising: (i) a second gage side guard plate having a second gage side guard plate interior surface, (ii) a second field side guard plate having a second field side guard plate interior surface, the second gage side guard plate and second field side guard plate defining a rail channel; and (iii) a second rail portion disposed in the rail channel and comprising a single machined billet having a gage side and a field side, a terminal end, a tread-bearing surface and a lower portion, the lower portion extending substantially the entire distance between the gage side guard plate interior surface and the field side guard plate interior surface, and the second rail portion comprising a flangeway machined alongside the tread-bearing surface; the second guard plate interior surface and the second field plate interior surface defining a space and wherein terminal end of the second rail portion extends outside the space; and wherein the movable portion is adapted to be moved between (1) a raised position and (2) a lowered position adjacent the stationary rail portion, such that the respective tread-bearing surfaces of the first rail portions are in substantial alignment with respective tread-bearing surfaces of the second rail portions.

The present invention also includes a rail bridge comprising a movable rail bridge joint comprising a guarded rail section according to the present invention in any of its embodiments.

The present invention thus provides several concomitant advantages over the prior art. The system of the present invention allows the required capture and guidance of the approaching wheel as it is presented while travelling through the bridge area.

The use of a single billet of rail stock or the like that is sized so as to substantially fill the rail channel affords the advantage of being able to provide the necessary construction with a minimum of parts that may become dislodged over time within the rail joint assembly, leading to insecurity in the wheel passage, as well as increased or accelerated wear upon the joint components.

With respect to the removable guard insert, this aspect of the invention allows for longer service life of the entire joint rail guard, by permitting the partial replacement of the more highly worn section(s) of the rail guard assembly.

In operation, the system of the present invention also provides for a secure wheel path and it accepts and allows the wheel to move through the respective bridge joint intersecting region. Rail joints of the present invention may be incorporated with canted rail systems that allow for speeds as high as 50-60 mph where desirable.

DETAILED DESCRIPTION OF THE PREFERRED EMBODIMENTS

Figure 1:
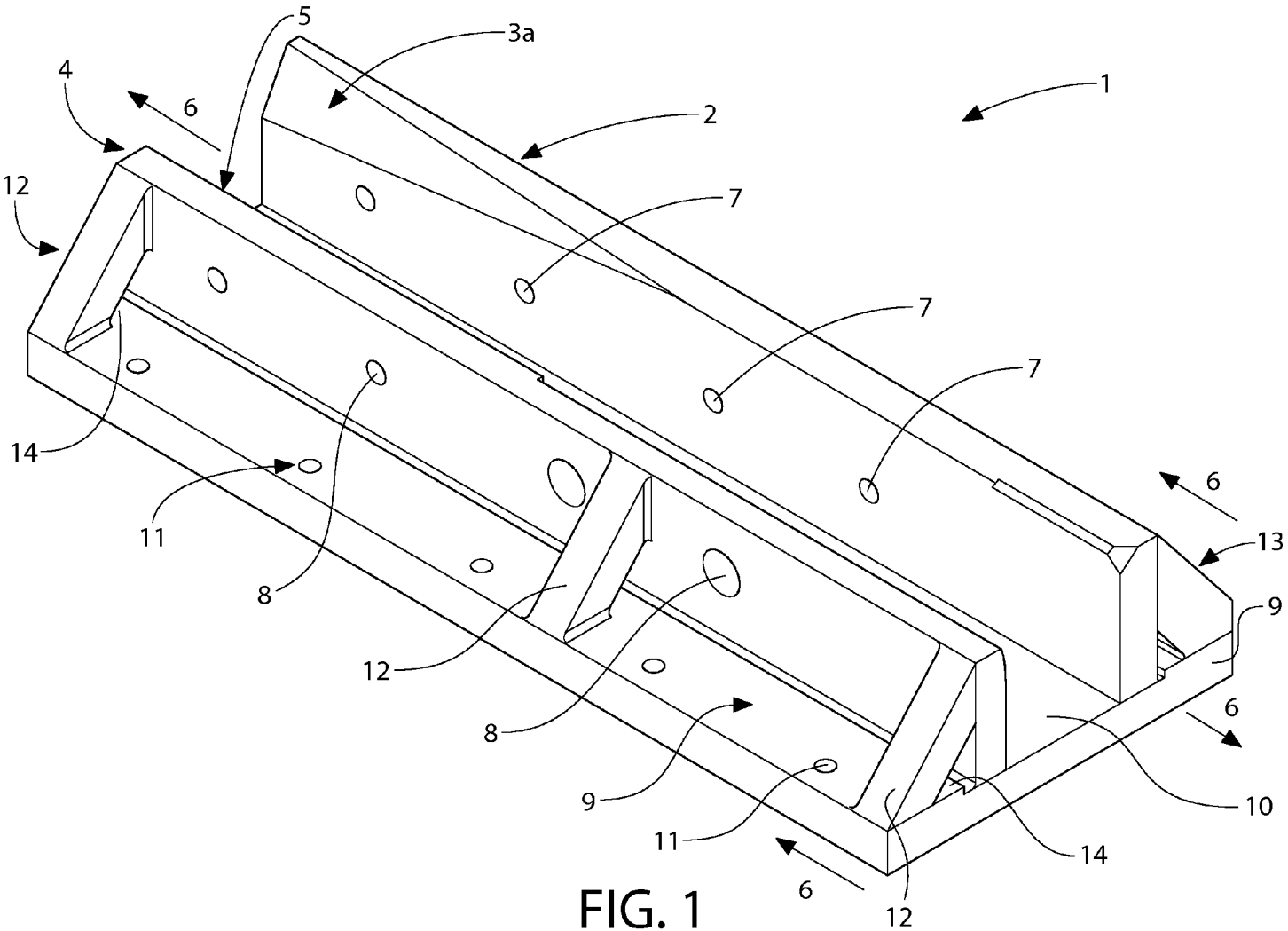
FIG. 1 is a top perspective view of a right hand approach rail bridge joint rail guard plate assembly for a movable bridge rail joint in accordance with one embodiment of the present invention.

In accordance with the foregoing summary, the following describes a preferred embodiment of the present invention which is considered to be the best mode thereof. With reference to the drawings, the invention will now be described in detail with regard for the best mode and preferred embodiment.

FIGS. 1-10 show, using like reference numerals, a guarded rail section and portions thereof, for a movable bridge rail joint, as well as its fixture within a rail panel assembly for a bridge section, in accordance with two embodiments of the present invention.

FIG. 1 is a top perspective view of a bridge joint rail guard plate assembly for a movable bridge rail joint in accordance with one embodiment of the present invention.

FIG. 1 shows joint plate assembly 1 (in this case, a right-hand approach plate) defining the position of a guarded rail section for a movable bridge rail joint. This view shows the gage side and the field side as indicated, and shows the gage side guard plate or bar 2 having a gage side guard plate interior surface 3, as well as a field side guard plate or bar 4 having a field side guard plate interior surface 5. In the preferred embodiment, the gage side guard plate interior surface 3 will be provided with a flare cut (such as flare cut 3*a*) on the approach end of the gage side guard plate or bar 2.

The gage side guard plate and field side guard plate define a rail channel 6 where the rail portion is held in a secure position.

FIG. 1 also shows the body bolt holes 7 in gage side guard plate or bar 2 as well as the body bolt holes 8 in field side guard plate or bar 4.

The rail channel 6 may be further defined by base plate 9 that typically and preferably will be provided with a milled seat 10 for the point end of the rail portion as will be seen in subsequent Figures. The base plate 9 also typically and preferably will be provided with screwspike holes 11. The joint plate assembly 1 may also feature side gussets, such as field side gussets 12 and gage side gussets 13. The gussets typically leave a clearance opening, such as opening 14, to allow heater rods to be placed along the base plate 9.

The joint plate assembly 1 may be constructed by any appropriate methods, such as by welding constituent pieces (as shown in FIG. 1), by fully machining the entire construction, or by first casting the construction followed by machining.

Figure 2:
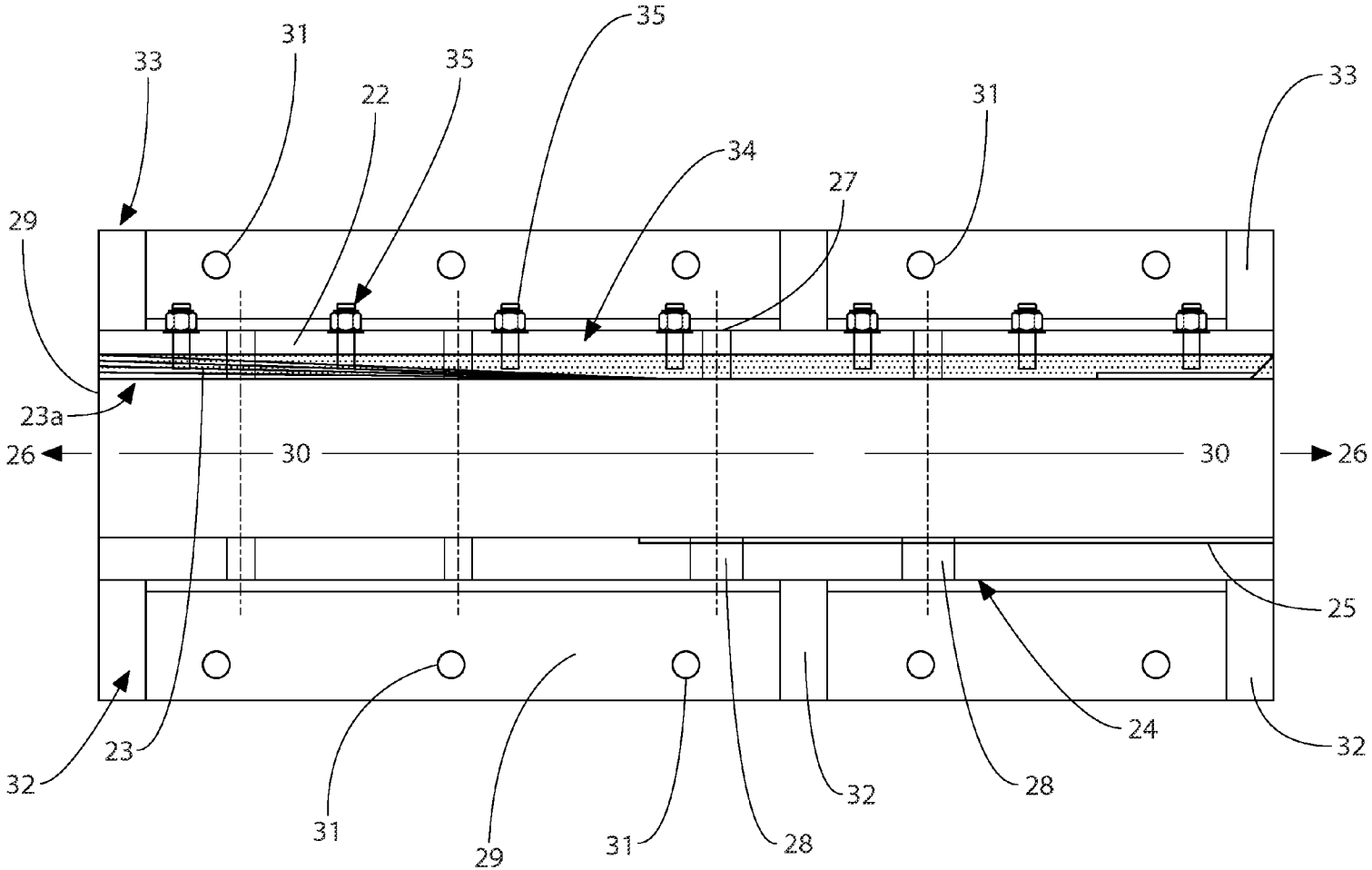
FIG. 2 is a top plan view of a right hand approach rail bridge joint rail guard plate assembly for a movable bridge rail joint, in accordance with another embodiment of the present invention.

FIG. 2 is a top plan view of a bridge joint rail guard plate assembly for a movable bridge rail joint, in accordance with another embodiment of the present invention.

FIG. 2 shows joint plate assembly 21 (in this case, a right-hand approach plate) defining the position of a guarded rail section for a movable bridge rail joint. This view shows the gage side and the field side as indicated, and shows the a gage side guard plate or bar 22 having a gage side guard plate interior surface 23, as well as a field side guard plate or bar 24 having a field side guard plate interior surface 25. In the preferred embodiment, the gage side guard plate interior surface 23 will be provided with a flare cut (such as flare cut 23*a*) on the approach end of the gage side guard plate or bar 22.

The gage side guard plate and field side guard plate define a rail channel 6 where the rail portion is held in a secure position.

FIG. 2 also shows the body bolt holes 27 in gage side guard plate or bar 22 as well as the body bolt holes 28 in field side guard plate or bar 24.

The rail channel 26 may be further defined by base plate 29 that typically and preferably will be provided with a milled seat 30 for the point end of the rail portion as will be seen in subsequent Figures. The base plate 29 also typically and preferably will be provided with screwspike holes 31. The joint plate assembly 1 may also feature side gussets, such as field side gussets 32 and gage side gussets 33.

In accordance with a preferred embodiment of the invention, FIG. 2 also shows the gage side guard plate interior surface 23 defining an insert channel 23*b* along its top portion, and additionally comprising a gage side top portion insert bar 34 removably attached into the insert channel 23*b*. The gage side top portion insert bar 34 is held in place by bar bolts 35. It is preferred that the interior surface of the top portion insert bar 34 be substantially co-extensive with the gage side guard plate interior surface 23 once fixed in position.

Figure 2A:
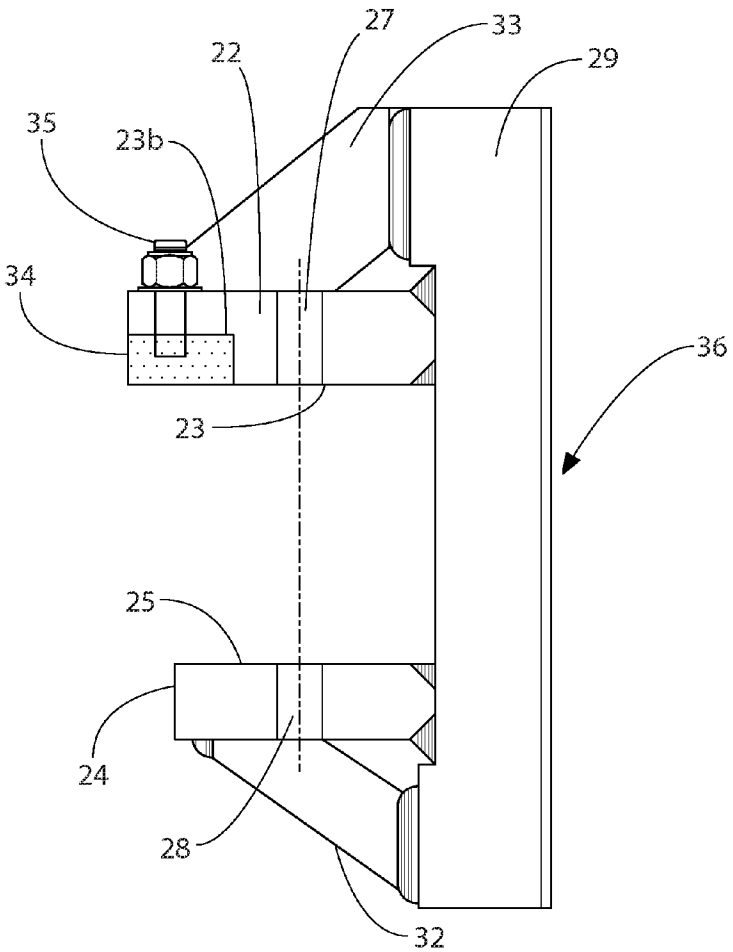
FIG. 2*a* is an approach side elevation view of a right hand approach rail bridge joint rail guard plate assembly for a movable bridge rail joint, in accordance with another embodiment of the present invention.

The joint plate assembly 21 may be constructed by any appropriate methods, such as by welding constituent pieces (as shown in FIGS. 2 and 2*a*), by fully machining the entire construction, or by first casting the construction followed by machining.

FIG. 2*a* is an approach side elevation view of a right hand approach rail bridge joint rail guard plate assembly for a movable bridge rail joint, in accordance with another embodiment of the present invention, and wherein like reference numerals refer to corresponding elements or features. This Figure shows another view of body bolt holes 27 in gage side guard plate or bar 22 as well as the body bolt holes 28 in field side guard plate or bar 24, as well as the relative position of the base plate 29. Also shown is tie pad or tie plate 36 that in turn is affixed to the railroad ties of the rail assembly.

This Figure further shows the gage side guard plate interior surface 23 defining an insert channel 23*b* along its top portion, and the gage side top portion insert bar 34 removably attached into the insert channel 23*b*. This Figure also shows how gage side top portion insert bar 34 is held in place by bar bolts 35, and how the interior surface of the top portion insert bar 34 is substantially co-extensive and even with the gage side guard plate interior surface 23 once fixed in position. It will be noted that a portion of this top portion insert bar 34 and insert channel 23*b* construction may be eliminated on the approach end to accommodate the inclusion of the flare cut 23*a* on the approach end of the gage side guard plate or bar 22, in which case the insert bar 34 will not extend the entire length of the gage side guard plate interior surface 23.

Figure 3:
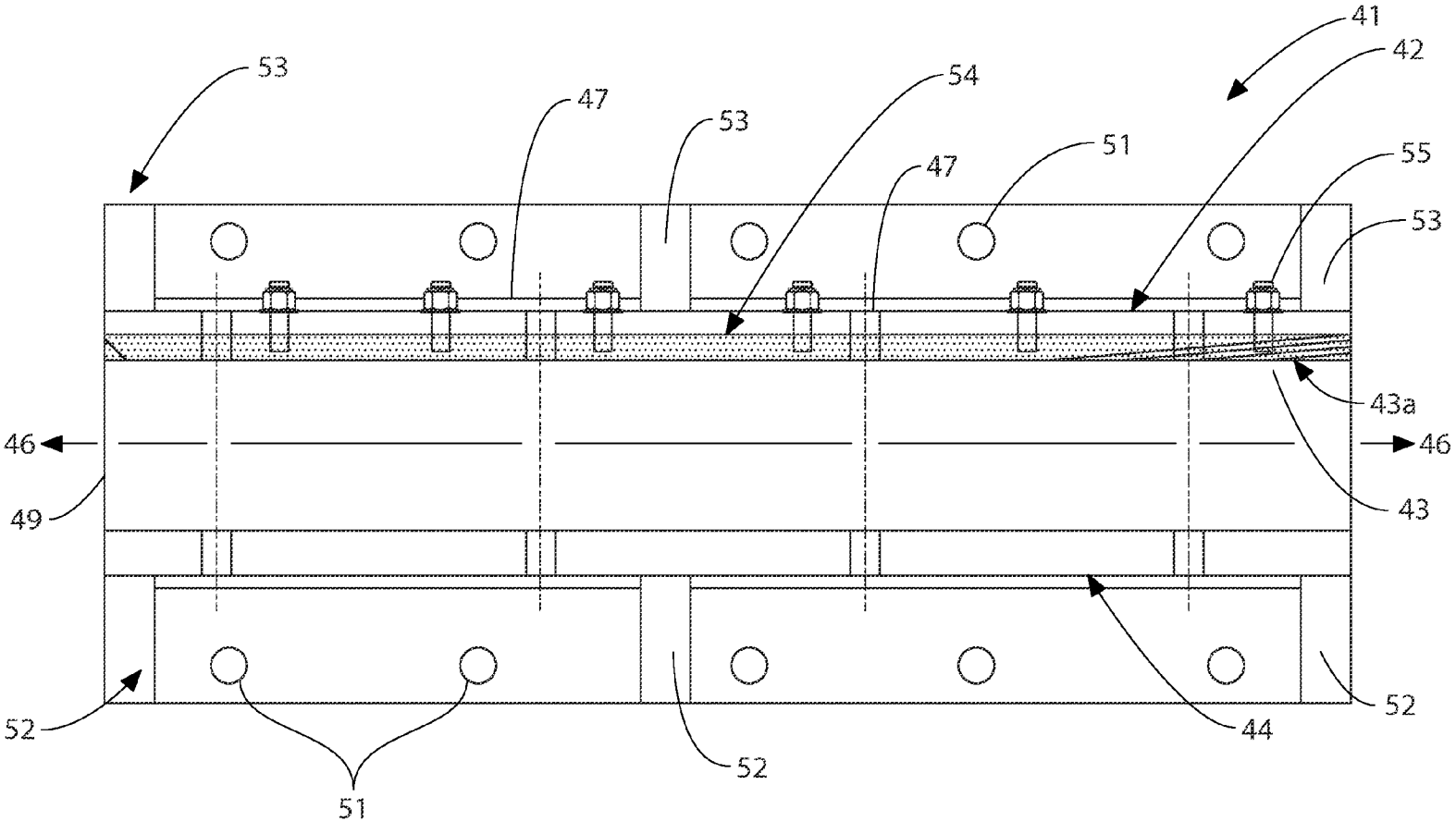
FIG. 3 is a top plan view of a right hand lift rail bridge joint rail guard plate assembly for a movable bridge rail joint, in accordance with another embodiment of the present invention.

FIG. 3 is a top plan view of a right hand lift rail bridge joint rail guard plate assembly for a movable bridge rail joint, in accordance with another embodiment of the present invention.

FIG. 3 shows joint plate assembly 41 (in this case, a right-hand approach plate) defining the position of a guarded rail section for a movable bridge rail joint. This view shows the gage side and the field side as indicated, and shows the gage side guard plate or bar 42 having a gage side guard plate interior surface 43, as well as a field side guard plate or bar 44 having a field side guard plate interior surface 45. In the preferred embodiment, the gage side guard plate interior surface 23 will be provided with a flare cut (such as flare cut 43*a*) on the approach end of the gage side guard plate or bar 42.

The gage side guard plate and field side guard plate define a rail channel 46 where the rail portion is held in a secure position.

FIG. 3 also shows the body bolt holes 47 in gage side guard plate or bar 42 as well as the body bolt holes 48 in field side guard plate or bar 44.

The rail channel 46 may be further defined by base plate 49 that typically and preferably will be provided with a milled seat 50 for the point end of the rail portion as will be seen in subsequent Figures. The base plate 49 also typically and preferably will be provided with screwspike holes 51. The joint plate assembly 1 may also feature side gussets, such as field side gussets 52 and gage side gussets 53.

FIG. 3 also shows the gage side guard plate interior surface 43 defining an insert channel 43*b* along its top portion, and additionally comprising a gage side top portion insert bar 54 removably attached into the insert channel 43*b*. The gage side top portion insert bar 54 is held in place by bar bolts 55. It is preferred that the interior surface of the top portion insert bar 54 be substantially co-extensive with the gage side guard plate interior surface 43 once fixed in position.

Figure 3A:
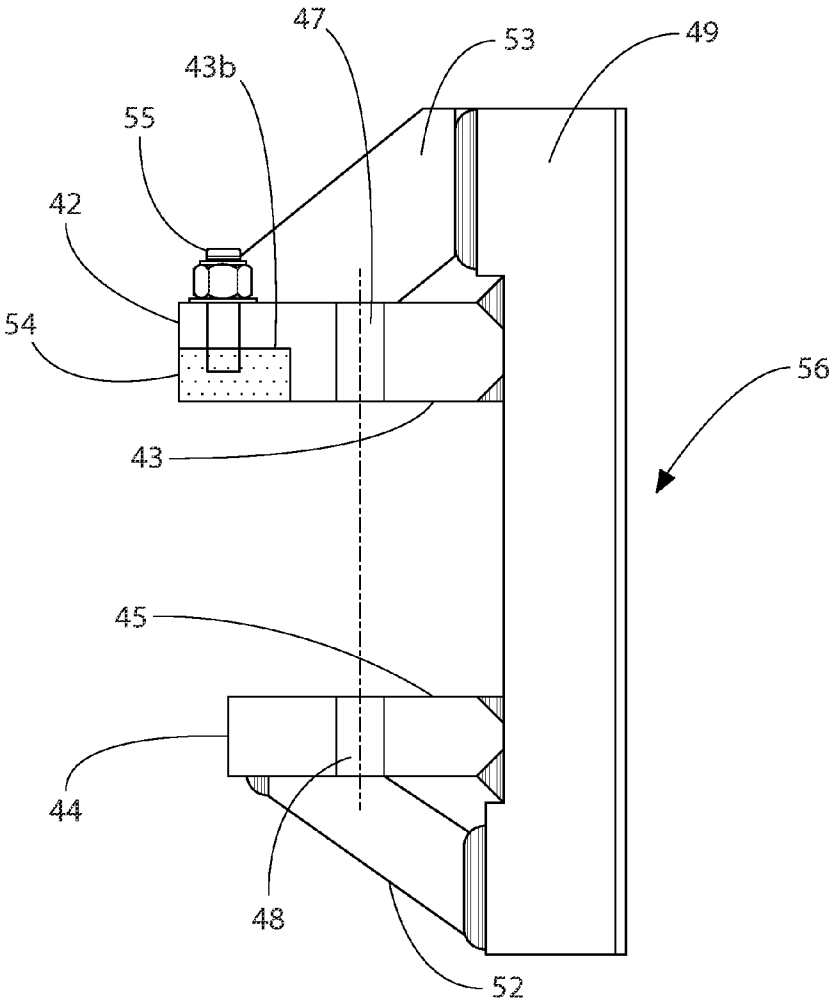
FIG. 3*a* is an approach side elevation view of a right hand lift rail bridge joint rail guard plate assembly for a movable bridge rail joint, in accordance with another embodiment of the present invention.

The joint plate assembly 41 may be constructed by any appropriate methods, such as by welding constituent pieces (as shown in FIGS. 3 and 3*a*), by fully machining the entire construction, or by first casting the construction followed by machining.

FIG. 3*a* is approach side elevation view of a right hand lift rail bridge joint rail guard plate assembly for a movable bridge rail joint, in accordance with another embodiment of the present invention, and wherein like reference numerals refer to corresponding elements or features. This Figure shows another view of body bolt holes 47 in gage side guard plate or bar 42 as well as the body bolt holes 48 in field side guard plate or bar 44, as well as the relative position of the base plate 49. Also shown is tie pad or tie plate 56 that in turn is affixed to the railroad ties of the rail assembly.

This Figure further shows the gage side guard plate interior surface 43 defining an insert channel 43*b* along its top portion, and the gage side top portion insert bar 54 removably attached into the insert channel 43*b*. This Figure also shows how gage side top portion insert bar 54 is held in place by bar bolts 55, and how the interior surface of the top portion insert bar 54 is substantially co-extensive and even with the gage side guard plate interior surface 43 once fixed in position. It will be noted that a portion of this top portion insert bar 54 and insert channel 43*b* construction may be eliminated on the approach end to accommodate the inclusion of the flare cut 43*a* on the approach end of the gage side guard plate or bar 42, in which case the insert bar 54 will not extend the entire length of the gage side guard plate interior surface 43.

Figure 4:
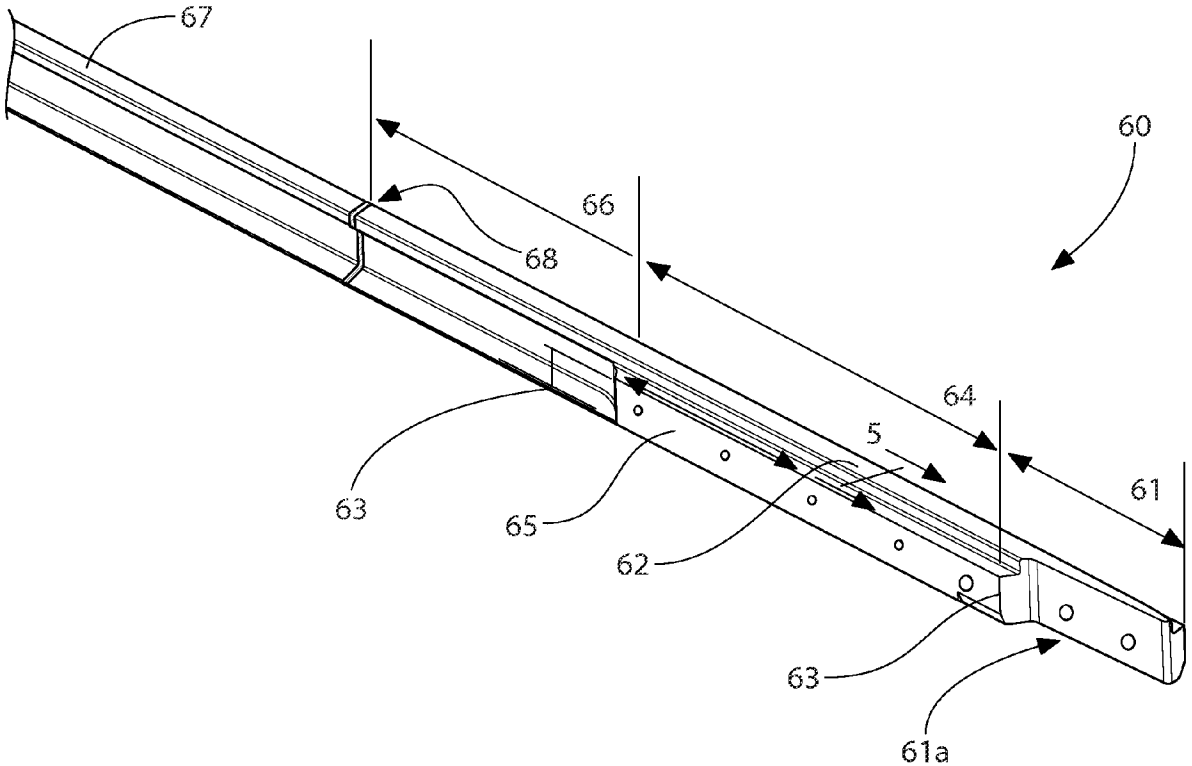
FIG. 4 shows an upper perspective view of a right hand lift rail portion used in a movable bridge joint in accordance with one embodiment of the present invention.

FIG. 4 shows an upper perspective view of a rail portion 60, in this case a right hand lift rail, used in a movable bridge joint in accordance with one embodiment of the present invention.

The rail portion 60 is to be placed in a rail channel of a lift side bridge joint rail guard plate assembly equivalent such as is shown in FIGS. 1-3*a*.

Rail portion 60 comprises a single machined billet, preferably of rail grade steel, having a gage side and a field side, a terminal or point end section 61, a tread-bearing surface 62, and a central body portion 64 having a lower portion 63. Rail portion 60 will have a central body portion 64 of sufficient width to have its lower portion 63 extending substantially the entire distance between the gage side guard plate interior surface and the field side guard plate interior surface of the joint rail guard plate assembly (see FIGS. 9 and 10). The central body portion 64 of rail portion 60 also includes a flangeway 65 machined alongside the tread-bearing surface 62.

Figure 9:
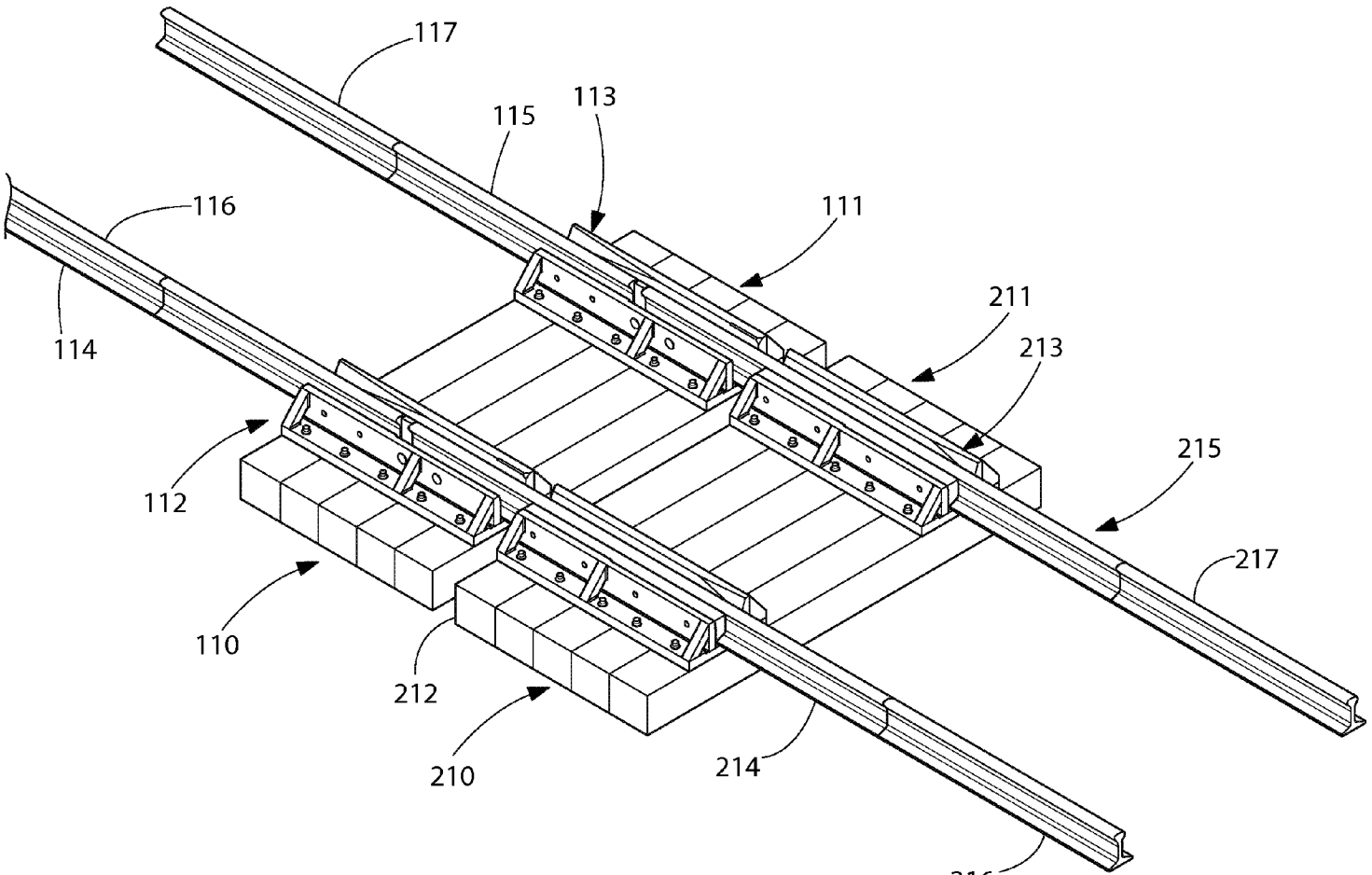
FIG. 9 shows an upper perspective view of a full movable bridge assembly incorporating the bridge point guard and rail arrangement, in accordance with one embodiment of the present invention.
Figure 10:
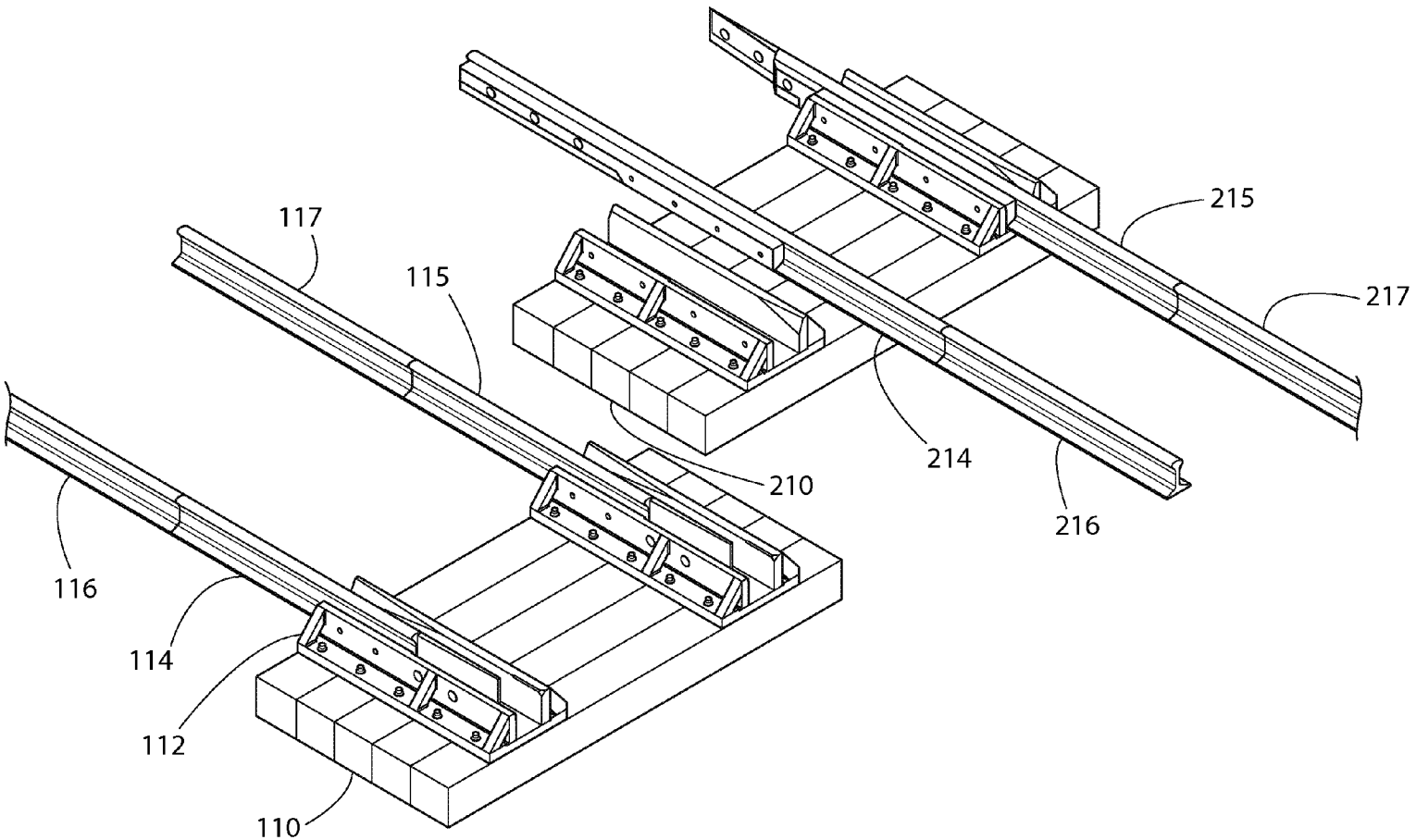
FIG. 10 shows an upper perspective view of a full movable bridge assembly in an open position, incorporating the bridge point guard and rail arrangement, in accordance with one embodiment of the present invention.

The flangeway 65 typically and preferably will be of sufficient width and depth to accommodate a rail wheel flange, as shown in greater detail in FIGS. 9 and 10. The central body portion 64 may also be provided with a machined outer way 65*a* to better define the tread-bearing surface 62 as can be appreciated from FIG. 5.

The terminal or point end section 61 will be provided with a tapered miter joint 61*a* (or equivalent shaping) to allow the lift rail to be aligned with and nested alongside a corresponding approach rail, such that the tread-bearing surface 62 aligns with that of the approach rail (such as may be appreciated from FIGS. 9 and 10).

Figure 4A:
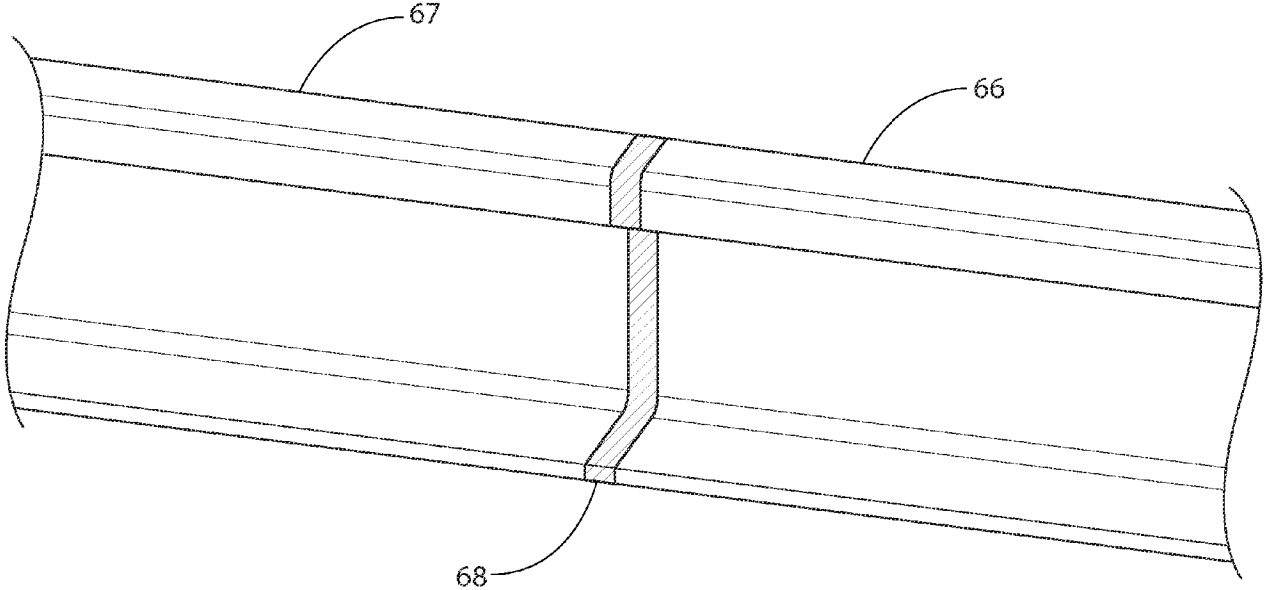
FIG. 4*a* shows detailed upper perspective view of reduction portion a rail portion, a stock rail and a friction butt weld seam, in accordance with one embodiment of the present invention.

Rail portion 60 preferably will also have a reduction portion 66 of a cross-sectional shape that corresponds to that of a stock rail 67 extending therefrom and to which the reduction portion 66 may be friction butt welded along friction butt weld seam 68 (see FIG. 4*a*).

FIG. 4*a* shows a detailed upper perspective view of reduction portion 66 of a cross-sectional shape that corresponds to that of a stock rail 67 extending therefrom and to which the reduction portion 66 may be friction butt welded along friction butt weld seam 68.

Figure 5:
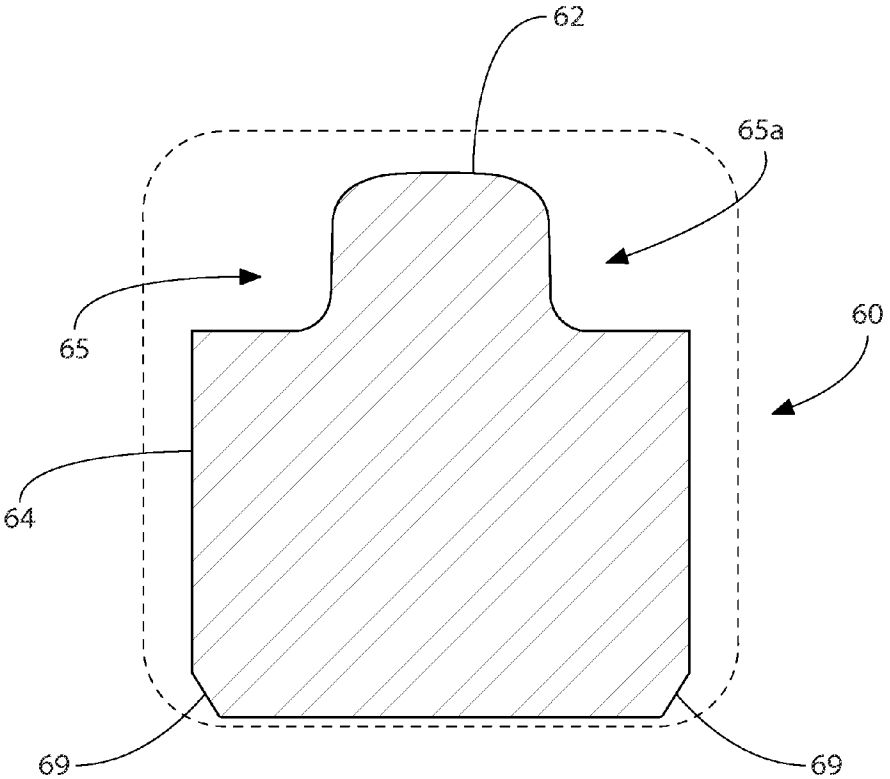
FIG. 5 is a cross-sectional view taken along line 5-5 of FIG. 4, and showing the preferred machining pattern used to form the central body portion of the rail portion of a movable bridge joint, in accordance with one embodiment of the present invention.

FIG. 5 is a cross-sectional view taken along line 5-5 of FIG. 4, and showing the preferred machining pattern used to form the central body portion 64 of rail portion 60 from an 8"×8" billet (dimensions shown in broken line). This Figure shows central body portion 64 of rail portion 60 and having flangeway 65, machined outer way 65*a* and tread-bearing surface 62. This billet is also machined to form a point end as shown in FIG. 4. FIG. 5 also shows preferred chamfer cuts 69 that provide ease of fit for the central body portion 64 into the rail guard plate assembly 1 as described with respect to FIG. 6.

Figure 5A:
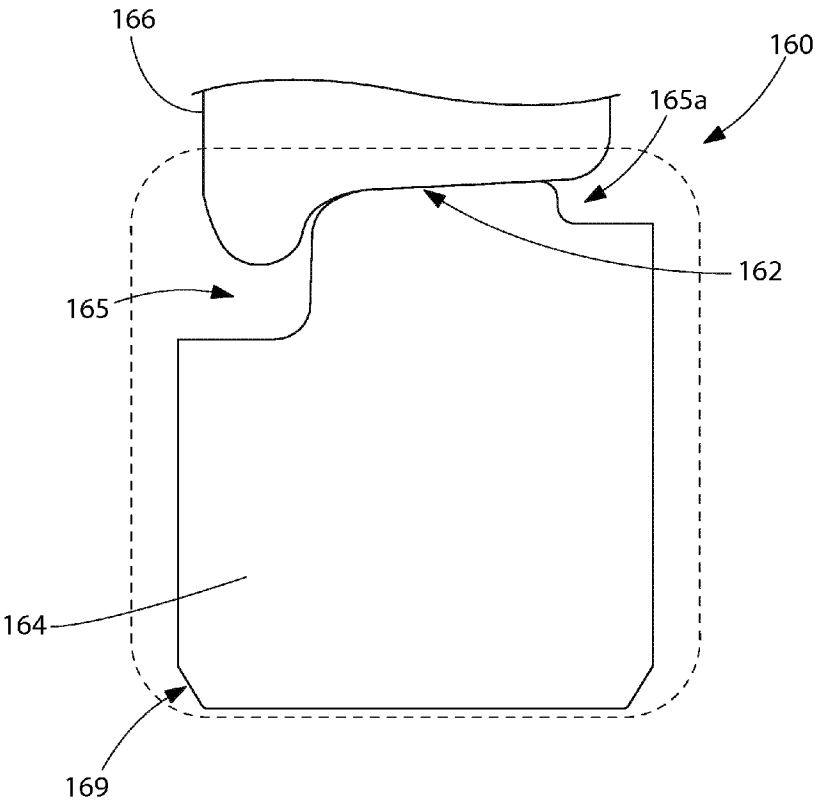
FIGS. 5*a* and 5*b* are cross-sectional views showing the preferred machining pattern used to form an alternative central body portion of the rail portion of a movable bridge joint, in accordance with another, preferred embodiment of the present invention.
Figure 5B:
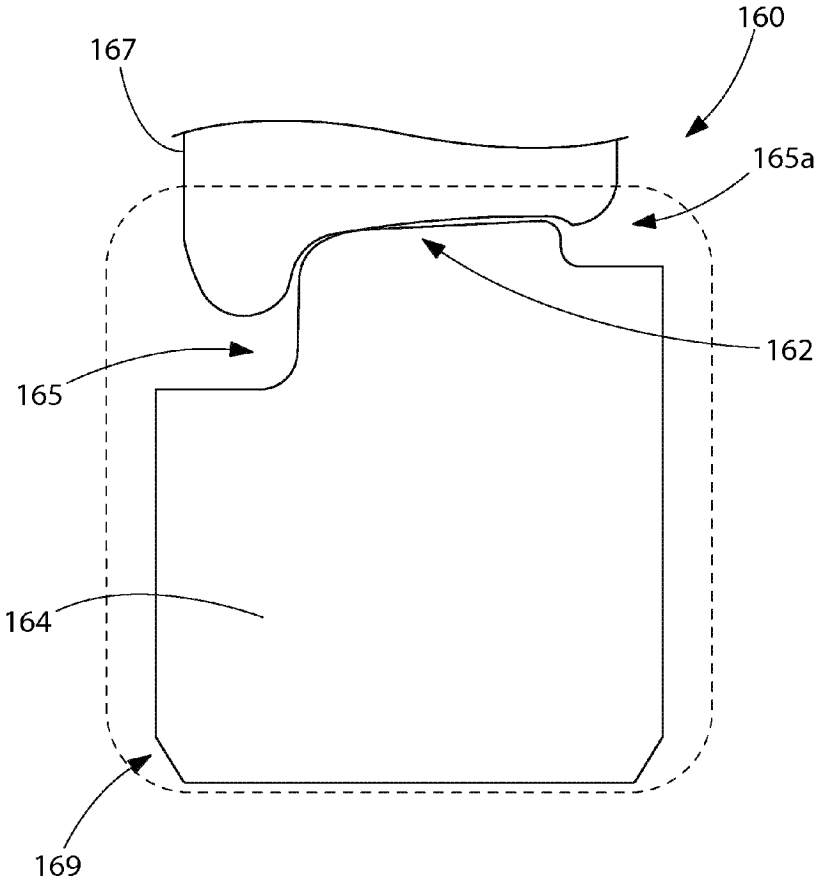

FIGS. 5*a* and 5*b* are cross-sectional views showing the preferred machining pattern used to form an alternative central body portion of the rail portion of a movable bridge joint, in accordance with another, preferred embodiment of the present invention. These Figures show a most preferred machining pattern used to form the central body portion 164 of rail portion 160 from an 8"×8" billet (dimensions shown in broken line). This Figure shows central body portion 164 of rail portion 160 and having flangeway 165, machined outer way 165*a* (for false flange clearance) and tread-bearing surface 162. This billet may also be machined to form a point end as shown in FIG. 4. FIGS. 5*a* and 5*b* also shows preferred chamfer cuts 169 that provide ease of fit for the central body portion 164 into the rail guard plate assembly 1 as described with respect to rail portion 60 in FIG. 6. These Figures also show that tread-bearing surface 162 is machined so as to provide a slope with respect to the natural horizontal and toward the gage side, preferably in the range of 1:15 to 1:25, most preferably 1:20. Typically, the bottom side of the billet will be at a right angle to the side of the billet, although other presentment angles may be used for the bottom of the billet depending upon the application.

The tread-bearing surface 162 preferably is substantially flat and is sloped upward from the gage side of the rail portion toward the field side of the rail portion and at an angle in the range of from about 1 in 10 to about 1 in 40 that would be conformal in nature so as to accommodate the slope of the railroad wheel tread typically sloped at about 1 in 20. Most preferably, the field side upper portion of the sloped tread-bearing surface is sufficiently notched (such as to form machined outer way 165*a*) so as to provide clearance for the outer lip false flange formed in worn rail car wheels.

FIGS. 5*a* and 5*b* also show the relative position of rail car wheels 166 and 167, respectively. FIG. 5*a* shows how the rail car wheel 166 in relatively new condition, fits against the tread-bearing surface 162. By contrast, FIG. 5*b* shows how the rail car wheel 167 in relatively worn condition and shows how it continues to engage the tread-bearing surface 162 and, when a "false flange" is formed by wear, machined outer way 165*a* accommodates the false flange by providing clearance therefor.

Figure 6:
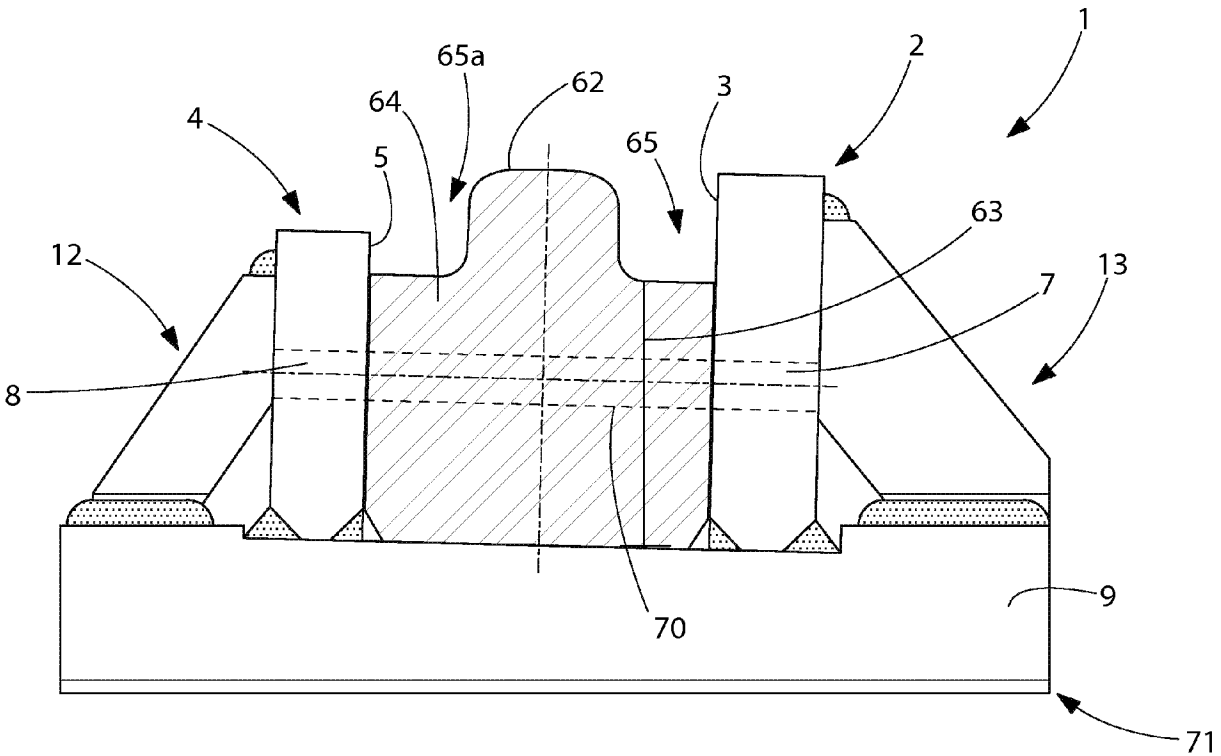
FIG. 6 is an end elevation view showing the central body portion of the rail portion sectioned and in position in a rail guard plate assembly of a movable bridge joint, in accordance with one embodiment of the present invention.

FIG. 6 is an end elevation view showing a rail guard plate assembly of a movable bridge joint 1 taken along line 6-6 of FIG. 1, with sectioned portion of central body portion 64 of the rail portion 60 (such as is shown in FIG. 5) positioned therein, in accordance with one embodiment of the present invention. In FIG. 6, like reference numerals refer to corresponding elements or features as shown and described with respect to FIGS. 1 and 5.

FIG. 6 shows joint plate assembly 1 provided with rail portion 60 having central body portion 64 and lower portion thereof 63. Also shown is flangeway 65, machined outer way 65*a* and tread-bearing surface 62. FIG. 6 also shows the gage side guard plate or bar 2 having a gage side guard plate interior surface 3, as well as a field side guard plate or bar 4 having a field side guard plate interior surface 5. FIG. 6 shows how the gage side guard plate and the field side guard plate define a rail channel where the rail portion 60 is held in a secure position after being lowered into place.

FIG. 6 also shows the body bolt holes 7 in gage side guard plate or bar 2 as well as the body bolt holes 8 in field side guard plate or bar 4. These holes are aligned with bolt hole 70 placed in the lower portion 63 of central body portion 64, to allow the central body portion 64 to be lowered into and secured within the rail channel 6 (as seen in FIG. 1) and upon a milled seat.

Figure 6A:
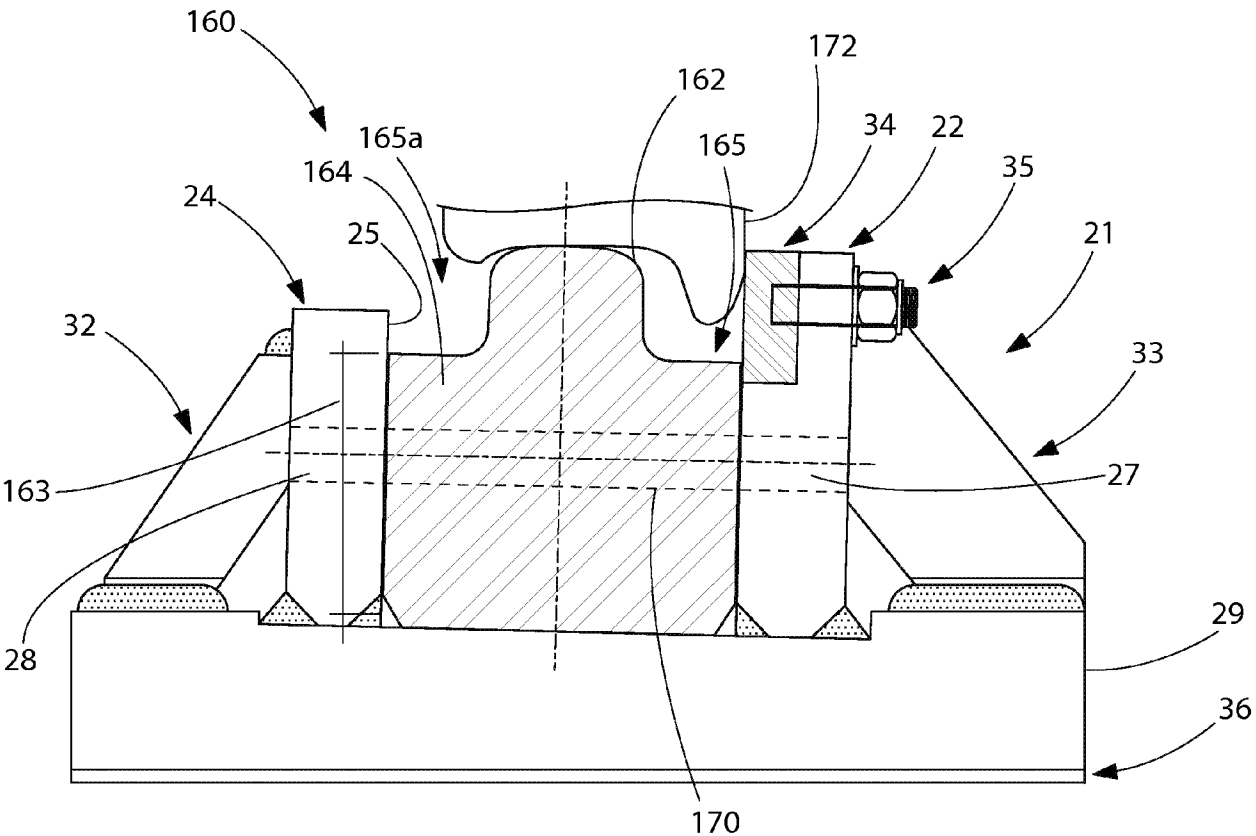
FIG. 6*a* is an end elevation view showing the central body portion of the rail portion sectioned and in position in a rail guard plate assembly of a movable bridge joint, in accordance with a preferred embodiment of the present invention.

FIG. 6*a* is an end elevation view showing an alternative, preferred rail guard plate assembly that may be incorporated into a movable bridge joint, such as that shown in FIG. 2, and wherein like reference numerals refer to corresponding elements or features. Positioned in the rail guard plate assembly is a rail portion 160 having a sectioned portion of central body portion 164 of the rail portion 160 (such as is shown in FIG. 5) positioned therein, in accordance with a preferred embodiment of the present invention.

FIG. 6*a* shows joint plate assembly 21 provided with rail portion 160 having central body portion 164 and lower portion thereof 163. Also shown is flangeway 165, machined outer way 165*a* and tread-bearing surface 162. FIG. 6*a* also shows the gage side guard plate or bar 22 having a gage side guard plate interior surface 23, as well as a field side guard plate or bar 24 having a field side guard plate interior surface 25. FIG. 6*a* shows how the gage side guard plate and the field side guard plate define a rail channel where the rail portion 160 is held in a secure position after being lowered into place.

FIG. 6*a* also shows the body bolt holes 27 in gage side guard plate or bar 22 as well as the body bolt holes 28 in field side guard plate or bar 24. These holes are aligned with bolt hole 170 placed in the lower portion 163 of central body portion 164, to allow the central body portion 164 to be lowered into and secured within the rail channel 6*a* (similar to the channel as seen in FIG. 1) and upon a milled seat.

FIG. 6*a* also shows the position of rail wheel 172 and the way in which it engages the replaceable wear bar 34.

Figure 7:
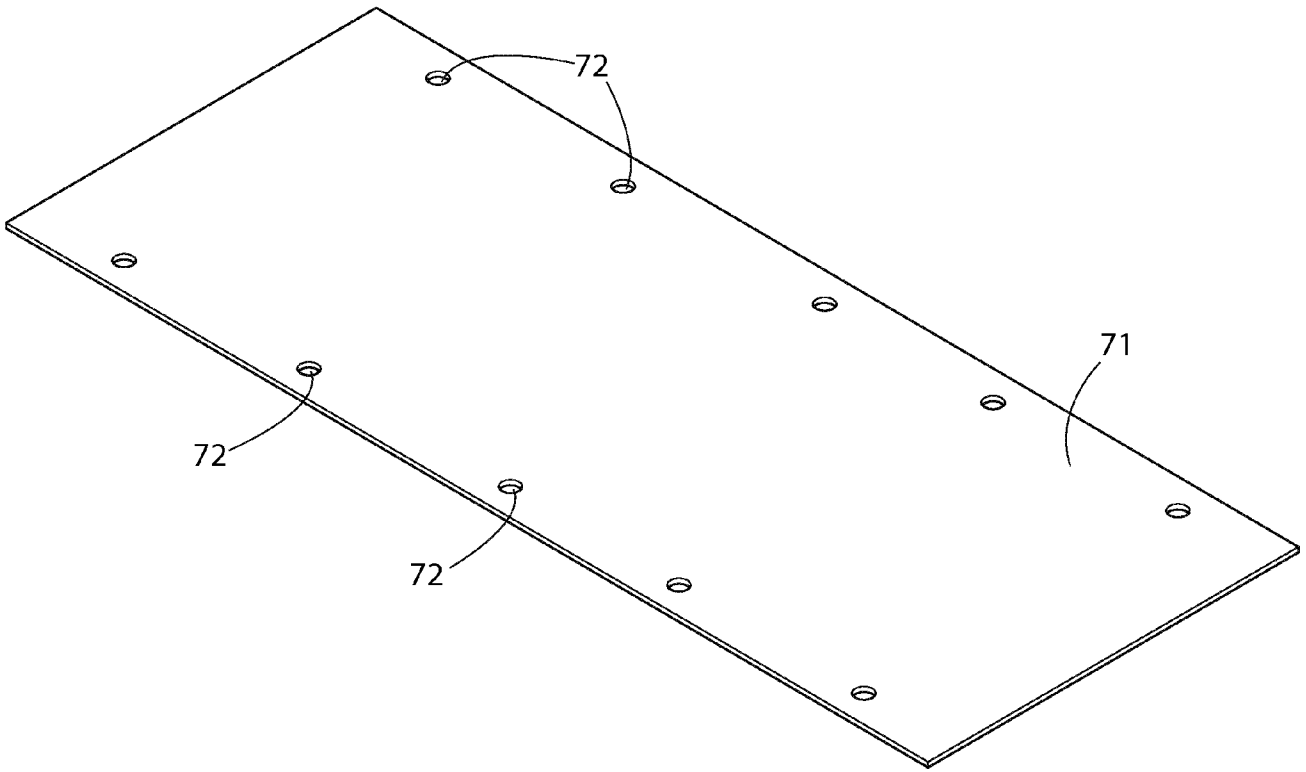
FIG. 7 shows a more detailed view of a tie pad or plate that may be used in accordance with one embodiment of the present invention.

FIG. 7 shows a more detailed view of tie pad or plate 71 having holes 72. The screwspike holes 11 in base plate 9 also align with corresponding holes 72 in tie pad or plate 71 upon which rests base plate 9, and which in turn is secured to the railroad ties of the corresponding bridge section.

Figure 8:
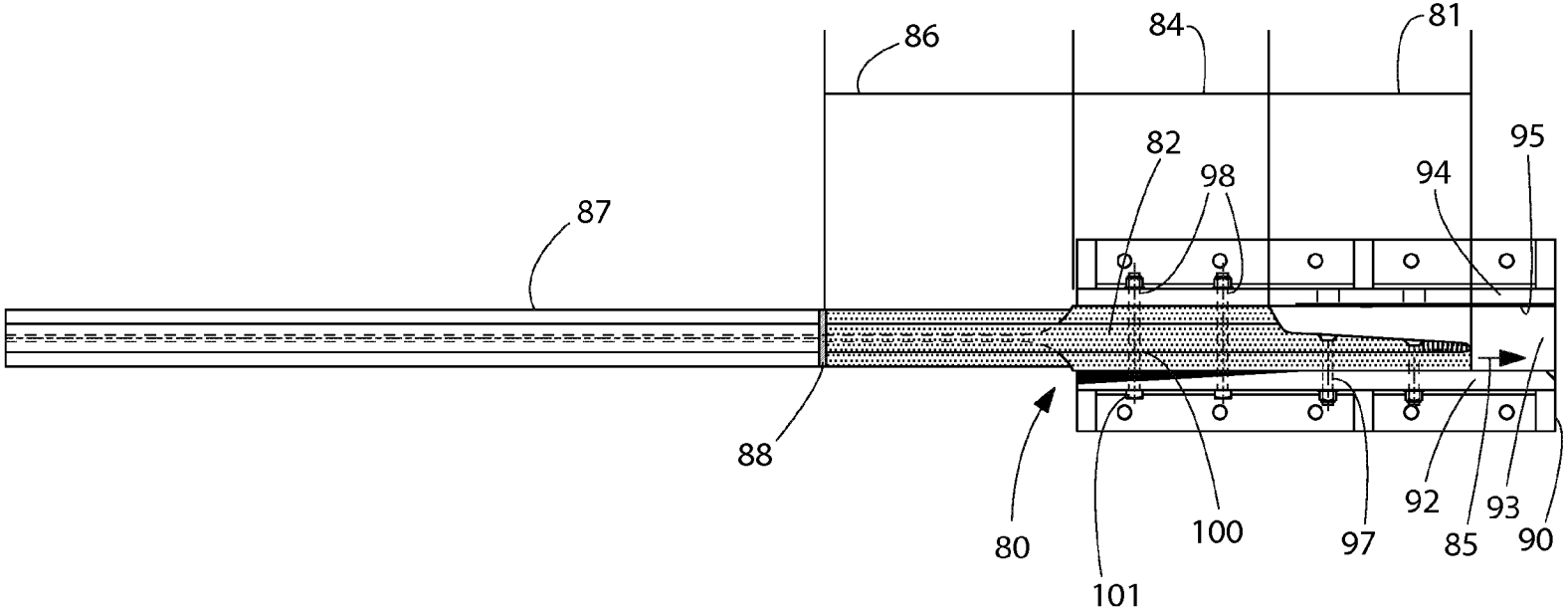
FIG. 8 is an end elevation view showing the central body portion of the rail portion sectioned and in position in a rail guard plate assembly of a movable bridge joint, in accordance with another embodiment of the present invention.

FIG. 8 is top plan view of an approach rail portion in position in an approach rail guard plate assembly 90 of a movable bridge joint (i.e., a mirror image of the rail guard plate assembly shown in FIG. 1), in accordance with another embodiment of the present invention. FIG. 8 shows joint plate assembly 90 provided with rail portion 80 having a terminal or point end section 81 and a central body portion 84 (and having a lower portion similar to lower portion 63 of the rail portion shown in FIG. 4, not shown in this Figure). Also shown is flangeway 85, machined outer way 85*a* and tread-bearing surface 82.

FIG. 8 is an end elevation view showing a rail guard plate assembly 81, with central body portion 84 of the rail portion 80 (similar to that shown in FIG. 4 with the exception that the lift rails will have relatively longer central body portions and the terminal or point ends extend from their respective rail guard plate assembly).

FIG. 8 also the gage side guard plate or bar 92 having a gage side guard plate interior surface 93, as well as a field side guard plate or bar 94 having a field side guard plate interior surface 95. FIG. 8 shows how the gage side guard plate and the field side guard plate define a rail channel where the rail portion 80 is held in a secure position after being lowered into place.

Rail portion 80 preferably will also have a reduction portion 86 of a cross-sectional shape that corresponds to that of a stock rail 87 extending therefrom and to which the reduction portion 66 may be friction butt welded along friction butt weld seam 88. FIG. 8 shows that reduction portion 86 of a cross-sectional shape that corresponds to that of a stock rail 87 extending therefrom and to which the reduction portion 86 may be friction butt welded along friction butt weld seam 88.

FIG. 8 also shows the body bolt holes 97 in gage side guard plate or bar 92 as well as the body bolt holes 98 in field side guard plate or bar 94. These holes are aligned with bolt holes 100 placed in the lower portion of central body portion 84, to allow the central body portion 84 to be lowered into and secured within the rail channel (as seen in FIG. 1) and upon a milled seat, by bolts 101.

FIG. 9 shows an upper perspective view of a full movable bridge assembly in a closed position, incorporating the bridge point guard and rail arrangement, in accordance with one embodiment of the present invention.

FIG. 9 shows the fixed or approach side panel 110 comprising approach ties 111 that in turn support right hand guard plate assembly 112 (described more fully herein as item 1 in FIG. 1), and left hand guard plate assembly 113. The right hand guard plate assembly 112 accepts right hand approach rail 114 while left hand guard plate assembly 113 accepts left hand approach rail 115 (as can be appreciated in more detail in FIG. 8; the right hand guard plate assembly 112 and right hand approach rail 114 arrayed in a mirror image thereof). FIG. 9 also shows the stock rail portions 116 and 117 welded onto the reduction extensions of right hand approach rail machined billets 114 and 115, respectively.

FIG. 9 also shows the movable or lift side panel 210 comprising approach or lift ties 211 that in turn support right hand guard plate assembly 212 (described more fully herein as item 1 in FIG. 1), and left hand guard plate assembly 213. The right hand guard plate assembly 212 accepts right hand lift rail 214 while left hand guard plate assembly 213 accepts left hand lift rail 215 (as can be appreciated in more detail in FIG. 8; the right hand guard plate assembly 212 and right hand lift rail 214 arrayed in a mirror image thereof). FIG. 9 also shows the stock rail portions 216 and 217 welded onto the reduction extensions of right hand approach rail machined billets 214 and 215, respectively.

FIG. 10 shows an upper perspective view of full movable bridge assembly in an open position, incorporating the bridge point guard and rail arrangement, in accordance with one embodiment of the present invention.

FIG. 10 shows the fixed or approach side panel 110 comprising approach ties 111 that in turn support right hand guard plate assembly 112 (described more fully herein as item 1 in FIG. 1), and left hand guard plate assembly 113. The right hand guard plate assembly 112 accepts right hand approach rail 114 while left hand guard plate assembly 113 accepts left hand approach rail 115 (as can be appreciated in more detail in FIG. 8; the right hand guard plate assembly 112 and right hand approach rail 114 arrayed in a mirror image thereof). FIG. 9 also shows the stock rail portions 116 and 117 welded onto the reduction extensions of right hand approach rail machined billets 114 and 115, respectively.

FIG. 10 also shows the movable or lift side panel 210 comprising approach or lift ties 211 that in turn support right hand guard plate assembly 212 (described more fully herein as item 1 in FIG. 1), and left hand guard plate assembly 213. The right hand guard plate assembly 212 accepts right hand lift rail 214 while left hand guard plate assembly 213 accepts left hand lift rail 215 (as can be appreciated in more detail in FIG. 8; the right hand guard plate assembly 212 and right hand lift rail 214 arrayed in a mirror image thereof). FIG. 10 also shows the stock rail portions 216 and 217 welded onto the reduction extensions of right hand approach rail machined billets 214 and 215, respectively.

The present invention may be used in accordance with any of several rail bridge types generally described as follows:

Vertical Lift Bridges—these are probably the most common with the center span being elevated vertically to a height that will allow the passage of vessels. An example of this type bridge may be found for instance in the form of a vertical lift bridge at the mouth of the Cuyahoga River in Cleveland, Ohio. This type of movement is typically provided by two lift towers that support the ends of the lift span.

Swing Span Bridges—this style bridge has a center span that rotates generally to a 90 degree position, often used in waterways where there are two shipping channels. The center pier incorporates a mechanized center shaft anchored and supported to provide the pivot point for the movement.

Bascule Bridges—there are many variations of this style bridge wherein the movement at one end is a radial motion with the opposite end acting as the pivot point. The movement is generated by means of a counterbalance assembly system that is moved to in turn create the lifting action at the opposite end.

The rail bridge joints of the present invention may be adapted for use and configured to be utilized on all of these bridge types.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claims, including the full range of equivalency to which each element thereof is entitled.

What is claimed is:

1. A movable rail bridge joint arrangement comprising:

a. a stationary portion having:

a) a first gage side guard plate having a first gage side guard plate interior surface, b) a first field side guard plate having a first field side guard plate interior surface, said first gage side guard plate and first field side guard plate defining a rail channel; and c) a first rail portion disposed in said rail channel and comprising a single machined billet having a gage side and a field side, a lead end, a terminal end, a tread-bearing surface and a lower portion, said lower portion extending substantially the entire distance between said gage side guard plate interior surface and said field side guard plate interior surface, and said first rail portion comprising a flangeway machined alongside said tread-bearing surface;

said terminal end of said first rail portion disposed between said first gage side guard plate and said first field side guard plate;

b. a movable portion having:

a) a second gage side guard plate having a second gage side guard plate interior surface, b) a second field side guard plate having a second field side guard plate interior surface, said second gage side guard plate and second field side guard plate defining a rail channel; and c) a second rail portion disposed in said rail channel and comprising a single machined billet having a gage side and a field side, a lead end, a terminal end, a tread-bearing surface and a lower portion, said lower portion extending substantially the entire distance between said gage side guard plate interior surface and said field side guard plate interior surface, and said second rail portion comprising a flangeway machined alongside said tread-bearing surface;

said second guard plate interior surface and said second field plate interior surface defining a space and wherein terminal end of said second rail portion extends outside said space; and wherein said movable portion is adapted to be moved between (1) a raised position and (2) a lowered position adjacent said stationary rail portion, such that said respective tread-bearing surfaces of said first and second portions are in substantial alignment.

2. A movable rail bridge joint arrangement according to claim 1 additionally comprising a base plate supporting said field side guard plate, gage side guard plate, and said rail portion.

3. A movable rail bridge joint arrangement according to claim 1 wherein said flangeway comprises a flangeway floor and wherein said gage side guard plate extends alongside said flangeway floor.

4. A movable rail bridge joint arrangement according to claim 1 wherein said terminal end of said rail portion has a tapered miter joint cut.

5. A movable rail bridge joint arrangement according to claim 4 wherein said terminal end of said rail portion resides between said guard plate interior surface and said field plate interior surface.

6. A movable rail bridge joint arrangement according to claim 4, said guard plate interior surface and said field plate interior surface defining a space and wherein terminal end of said rail portion extends outside said space.

7. A movable rail bridge joint arrangement according to claim 1 wherein said flangeway comprises a flangeway floor, said gage side guard plate has a gage side guard plate top surface, said field side guard plate has a field side guard plate top surface, and wherein said gage side guard plate top surface and said field side guard plate top surface extends above said flangeway floor.

8. A movable rail bridge joint arrangement according to claim 1 wherein said gage side guard plate interior surface defines an insert channel along its top portion, and additionally comprising a top portion insert removably attached into said insert channel.

9. A movable rail bridge joint arrangement according to claim 8 wherein said top portion insert comprises a top portion interior surface, and wherein said top portion interior surface is substantially co-extensive with said gage side guard plate interior surface.

10. A movable rail bridge joint arrangement according to claim 1 wherein said second gage side guard plate interior surface comprises a chamfer cut portion.

11. A movable rail bridge joint arrangement according to claim 1, additionally comprising a stock rail aligned with and attached to each respective said lead ends of said first and second rail portions.

12. A movable rail bridge joint arrangement according to claim 1, wherein said lead ends each have a cross-sectional profile matching that of a stock rail, and additionally comprising a stock rail welded onto each respective said lead ends of said first and second rail portions.

13. A rail bridge comprising a movable rail bridge joint according to claim 1.

14. A movable rail bridge joint arrangement comprising:

a) a stationary portion having a first pair of parallel guarded rail sections, each comprising:

i. a first gage side guard plate having a first gage side guard plate interior surface, ii. a first field side guard plate having a first field side guard plate interior surface, said first gage side guard plate and first field side guard plate defining a rail channel; and iii. a first rail portion disposed in said rail channel and comprising a single machined billet having a gage side and a field side, a lead end, a terminal end, a tread-bearing surface and a lower portion, said lower portion having flat lateral sides and extending substantially the entire distance between said gage side guard plate interior surface and said field side guard plate interior surface, and said first rail portion comprising a flangeway machined alongside said tread-bearing surface;

said terminal end of said first rail portion disposed between said first gage side guard plate and said first field side guard plate;

b) a movable portion having a second pair of parallel guarded rail sections, each comprising:

i. a second gage side guard plate having a second gage side guard plate interior surface, ii. a second field side guard plate having a second field side guard plate interior surface, said second gage side guard plate and second field side guard plate defining a rail channel; and iii. a second rail portion disposed in said rail channel and comprising a single machined billet having a gage side and a field side, a lead end, a terminal end, a tread-bearing surface and a lower portion, said lower portion extending substantially the entire distance between said gage side guard plate interior surface and said field side guard plate interior surface, and said second rail portion comprising a flangeway machined alongside said tread-bearing surface;

said second guard plate interior surface and said second field plate interior surface defining a space and wherein terminal end of said second rail portion extends outside said space; and c) a stock rail aligned with and attached to each respective said lead ends of said first and second rail portions;

wherein said movable portion is adapted to be moved between (1) a raised position and (2) a lowered position adjacent said stationary rail portion, such that said respective tread-bearing surfaces of said first rail portions are in substantial alignment with respective tread-bearing surfaces of said second rail portions.

15. A rail bridge comprising a movable rail bridge joint according to claim 14.

* * * * *